US006938343B2

(12) United States Patent
Yamagishi

(10) Patent No.: US 6,938,343 B2
(45) Date of Patent: Sep. 6, 2005

(54) PACKAGE OPENING CUTTER

(75) Inventor: Jyuro Yamagishi, Osaka (JP)

(73) Assignee: Paltac Corporation, Osaka (JP)

( * ) Notice: Subject to any disclaimer, the term of this patent is extended or adjusted under 35 U.S.C. 154(b) by 174 days.

(21) Appl. No.: 10/353,972

(22) Filed: Jan. 30, 2003

(65) Prior Publication Data

US 2003/0140746 A1 Jul. 31, 2003

(30) Foreign Application Priority Data

Jan. 31, 2002 (JP) ..... 2002-022924

(51) Int. Cl.[7] ..... B26B 1/08
(52) U.S. Cl. ..... 30/2; 30/289
(58) Field of Search ..... 30/287, 330, 331, 30/335, 2, 125, 286, 288, 289, 294, 329; 7/163

(56) References Cited

U.S. PATENT DOCUMENTS 2,067,986 A * 1/1937 Schmidt
2,247,290 A * 6/1941 Disbrow ..... 30/2
2,486,900 A * 11/1949 Willis
2,644,230 A * 7/1953 Anderson ..... 30/151
4,031,616 A * 6/1977 Hines et al. ..... 30/2
4,048,719 A * 9/1977 Thompson ..... 30/2
4,503,612 A * 3/1985 Davis ..... 30/2
4,675,996 A * 6/1987 DuBuque ..... 30/2
5,285,575 A * 2/1994 Hirano ..... 30/2
5,333,381 A * 8/1994 Gelardi et al. ..... 30/2
6,637,112 B2 * 10/2003 Davis ..... 30/2

FOREIGN PATENT DOCUMENTS

JP 2001-322615 11/2001

* cited by examiner

*Primary Examiner*—Hwei-Siu Payer
(74) *Attorney, Agent, or Firm*—Wenderoth, Lind & Ponack, L.L.P.

(57) ABSTRACT

A package opening cutter is provided which can accurately, safely and efficiently open the package without damaging the merchandise inside and in which the cutter will not come out during use. It comprises an angle ruler, retaining portions provided at both sides of the angle ruler, a clamp body provided so as to be pushed into and pulled out of the retaining portion for clamping a cutter, and an arrangement for preventing the clamp body from coming out of the retaining portion. The arrangement for preventing the clamp body from coming out has a bolt slidably provided between the cutter retaining portions and the cutter clamp body. The bolt is operated by a knob provided on an outer surface of the cutter retaining portion.

5 Claims, 9 Drawing Sheets

PACKAGE OPENING CUTTER

BACKGROUND OF THE INVENTION

This invention relates to a package opening cutter used to open a carton, particularly a package in which a plurality of pieces of merchandise are packaged.

Generally, a plurality of pieces of merchandise are packaged in a carton and sorted in a distribution stage according to order amounts by opening the carton, and are then dispatched. At a retail store, the carton is opened and the merchandise is taken out and displayed.

At large stores, to save manpower, a business method is sometimes adopted in which instead of displaying all the goods, cartons are stacked with their top open to give people an impression that they are sold at low prices.

For such purpose, tops of cartons are frequently cut and opened. If the top of a carton 81 is opened with an ordinary cutter 82 as in FIG. 11, there is a fear that the cutter may damage the merchandise S inside. Also a worker may get injured due to a slip of his hand. Further, it is difficult to cleanly cut and open packages.

The applicant has proposed a cutter, as disclosed in JP patent publication 2001-322615.

The cutter makes it possible to accurately cut along corners of a carton without damaging the merchandise inside while ensuring safety of work and to improve work efficiency.

But when the package opening cutter is used repeatedly, due to a thrust acting on the cutting edge, a cutter clamping body (hereinafter simply referred to as a clamp body) tends to come out of a cutter retaining portion (hereinafter simply referred to as a retaining portion.

An object of this invention is to provide a package opening cutter in which the cutter will never come out of the retaining portion together with the clamp body even after repeated use without impairing advantages of the package opening cutter.

SUMMARY OF THE INVENTION

According to this invention, there is provided a package opening cutter comprising an angle ruler, retaining portions provided at both sides of the angle ruler, a clamp body provided so as to be pushed into and pulled out of the retaining portions for clamping a cutter, and an arrangement for preventing the clamp body from coming out of the retaining portions.

According to this invention, it is possible to accurately, safely and efficiently open a package along corners of a carton without damaging the merchandise inside and without the fear of getting a cut and also prevent the cutter from coming out together with the clamp body.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1A:
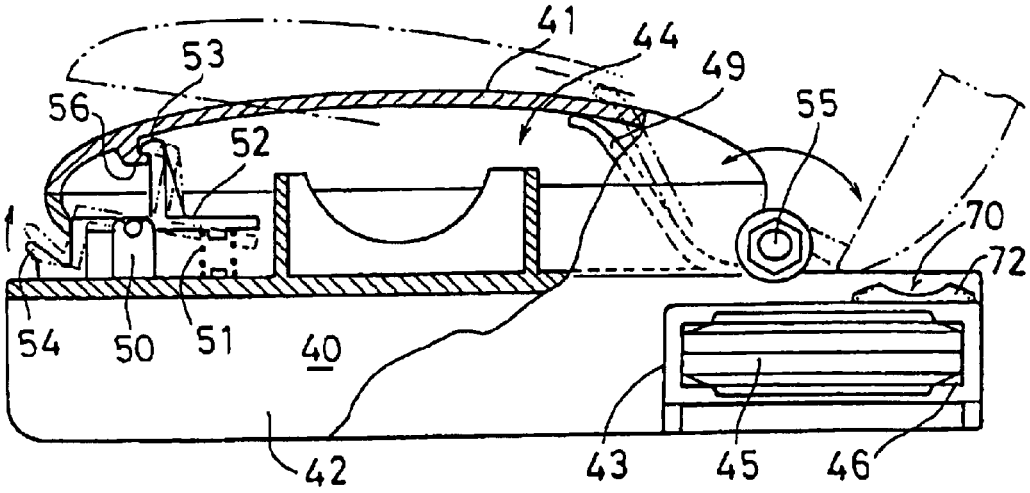
FIG. 1A is a partially cutaway front view of the package opening cutter according to this invention.

An embodiment of this invention will be described with reference to the drawings. As shown in FIG. 1, the package opening cutter (device) 40 comprises an angle (or angled) ruler (or guide) 42, retaining portions 43, a cutter box 44, a clamp body 45 and a fall-preventive means 70, all formed by molding a plastic. The retaining portions 43 are integrally provided at one end of the angle ruler 42 at both sides thereof. The retaining portions 43 each have a through hole (or opening) 46 for receiving the clamp body 45. In the through hole 46, notches 47 are formed to adjust the cutting edge of a cutter (or cutter blade) 48 (FIG. 2A) sandwiched in the clamp body 45.

The cutter box 44 has housing spaces 68*a* and 68*b* for cutters 48 (68*a* is a space for housing brand-new cutters; 68*b* is a space for housing used cutters), a spring piece 49, a bearing 50, a balance 52 supported on the bearing 50 and biased by a spring 51, a hook 53 integral with the balance 52, and a tab 54 integral with the balance 52 and protruding out of the cutter box 44.

At one end, a lid 41 has a hinge 55*a* pivotally mounted on a shaft 55 secured to the cutter box. The hook 53 is adapted to engage a claw 56 formed on the inner surface of the lid 41 to keep the lid 41 shut (FIG. 1A). The spring piece 49 engages the inner surface of the lid 41, thereby biasing the lid 41 in an opening direction.

Figure 2A:
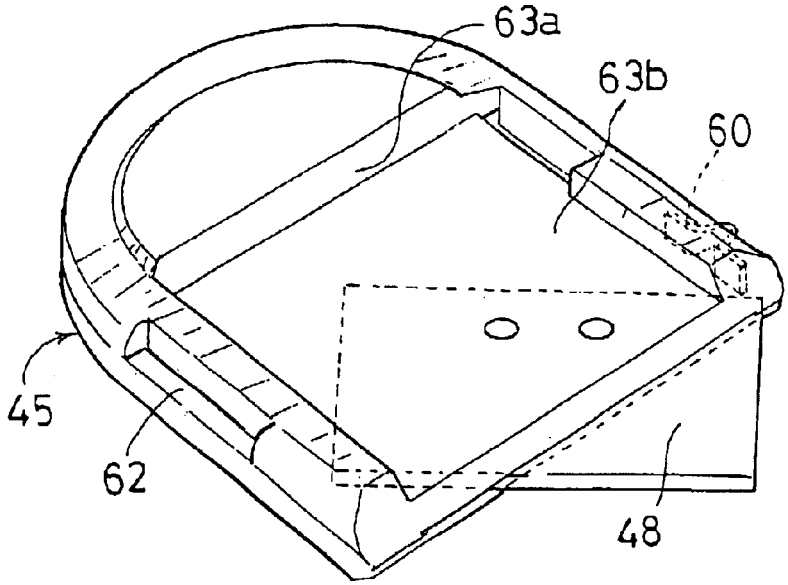
FIG. 2A is a perspective view of the clamp body.
Figure 2B:
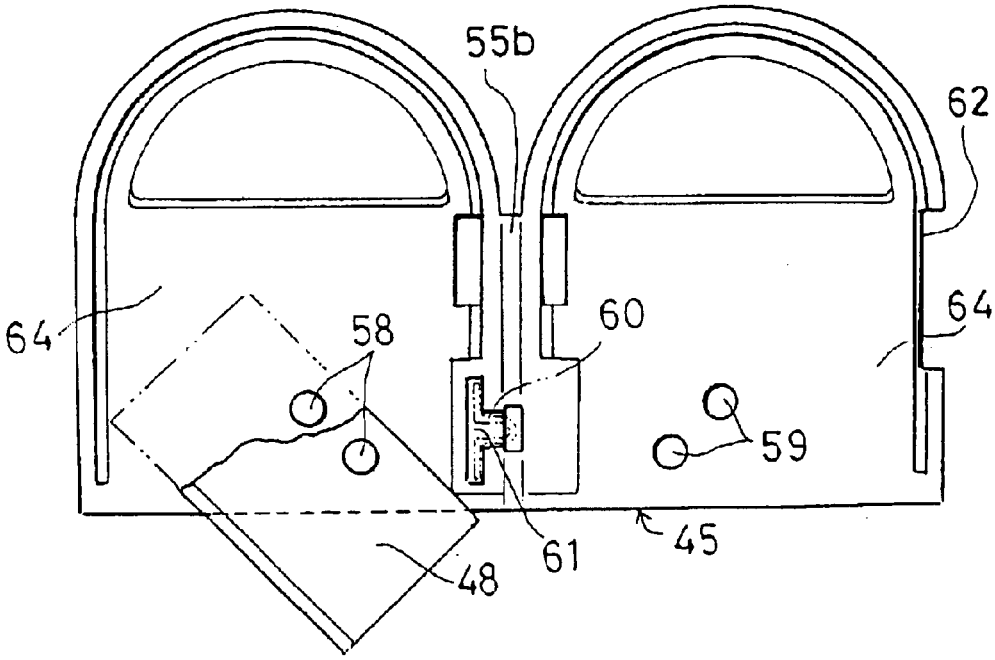
FIG. 2B is a plan view thereof with its hinge opened.

As shown in FIG. 2A, the clamp body 45, which clamps the cutter 48, is formed by injection-molding a plastic, and has a recess 57 (FIG. 3B) for receiving the cutter 48, two protrusions 58 for positioning the cutter 48, holes 59 for receiving the protrusions 58, a recess 61 for receiving a Ω-shaped spring 60, and a cutout 62 for opening the clamp body 45. At its portion where the cutter 48 is not sandwiched, a step 63*a* having a large wall thickness is formed, while at its portion where the cutter 48 is sandwiched, a recess 63*b* is formed, with side walls 63*c* being defined along sides of the recess 63*b*. Two plates 64 are formed and connected together by a hinge 55*b* (FIG. 2B).

When the cutter 48 is fitted in the recess 57 and on the protrusions 58 with the Ω-shaped spring 60 received in the recess 61 and the plates 64 folded, it is placed in the state of FIG. 2A. In this state, as seen in FIG. 3B, the opposed surfaces of the plates 64 face and fit each other with the Ω-shaped spring 60 slightly protruding outward.

Figure 3A:
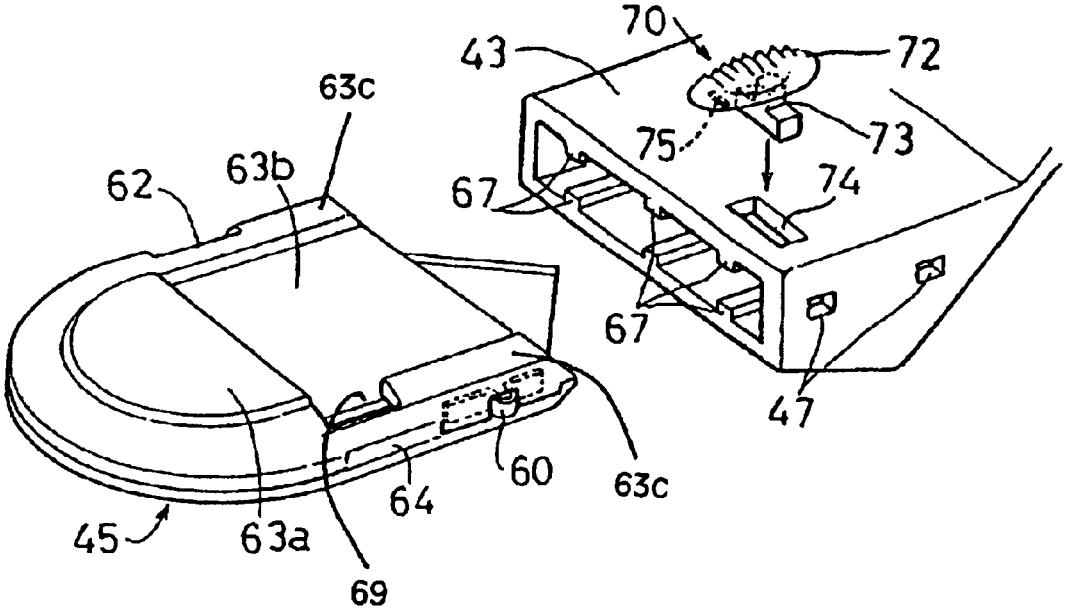
FIG. 3A is an explanatory view showing how the clamp body is mounted.
Figure 3B:
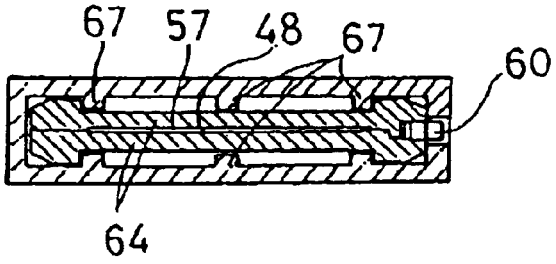
FIG. 3B is a sectional view of the clamp body mounted.

The clamp body 45, which is clamping the cutter 48, is fitted in one of the two retaining portions 43 (FIG. 3A). At this time, the recess 63*b* engages ribs 67 formed in the retaining portion 43 to prevent lateral shaking. The Ω-shaped spring 60 fit in a notch 47 so that the cutting edge can be adjusted in one of two positions, i.e. in the package opening state and the retracted state. The retaining portions 43 are provided on both wings of the angle ruler 42 so that a user can use it irrespective of whether he or she is a right-hander or left-hander.

Figure 4:
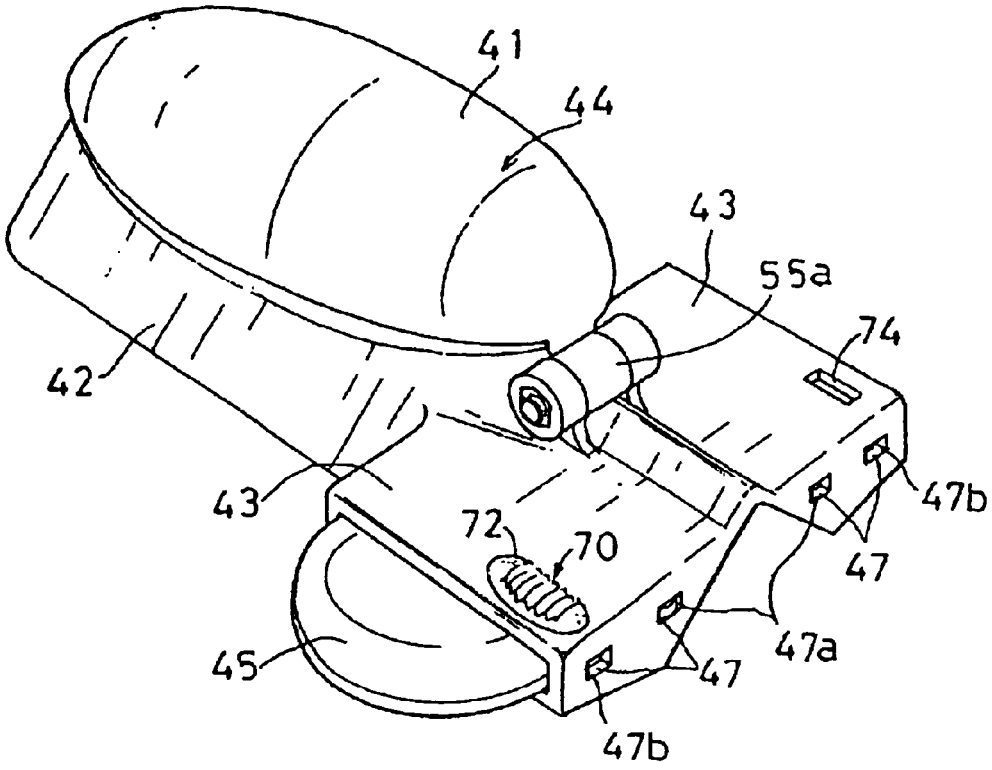
FIG. 4 is a perspective view of the package opening cutter.
Figure 5:
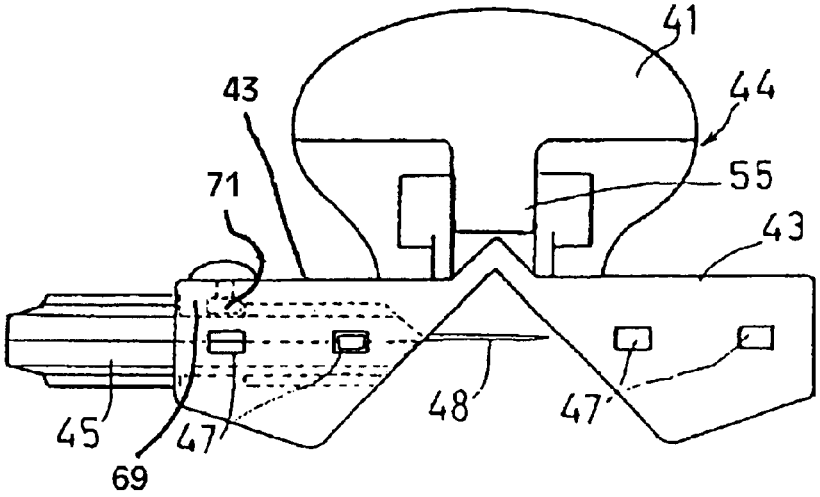
FIG. 5 is a side view of the same.
Figure 6:
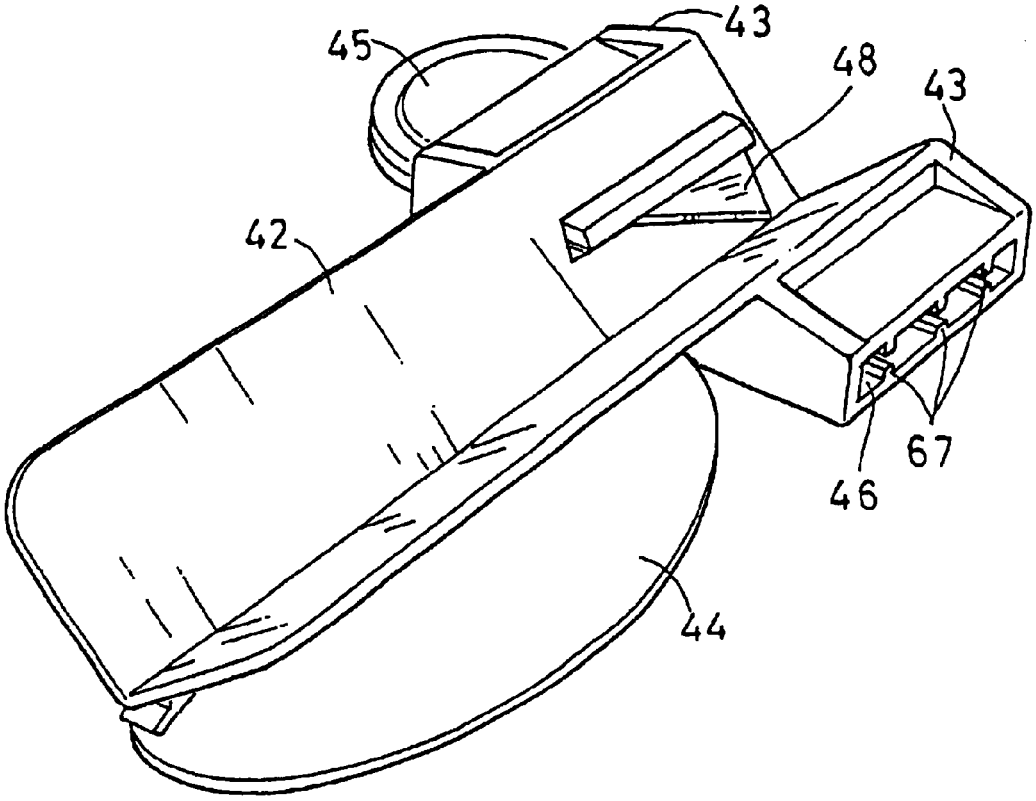
FIG. 6 is a perspective view as seen from the back of the same.
Figure 7:
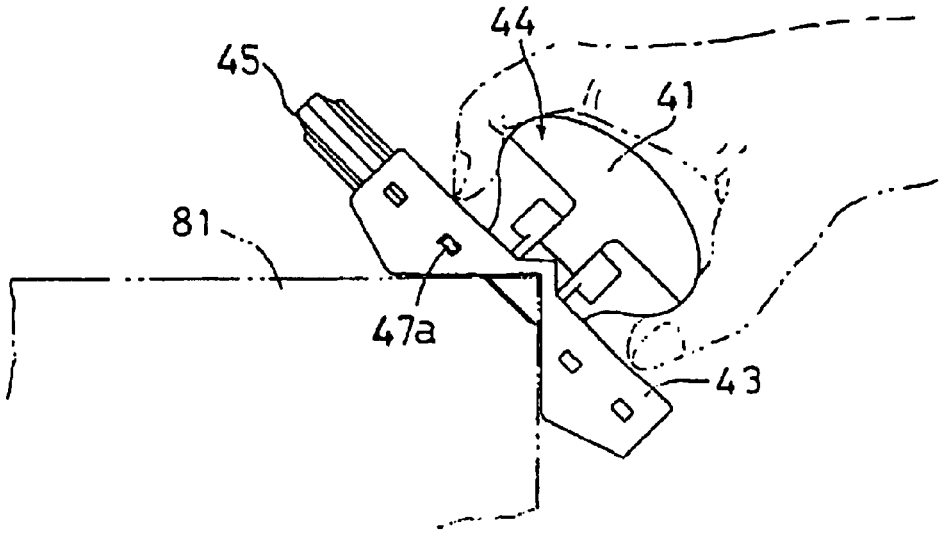
FIG. 7 is an explanatory view showing how it is used.

FIGS. 4 to 6 show how the cutter 48 is mounted in one of the retaining portions 43 through the clamp body 45 and is used. FIG. 7 shows how a package is cut with the Ω-shaped spring 60 fitting in the notch 47*a*. Now the cutter 48 protrudes markedly to cut and open the top of a carton 81. When the package opening work ends, the Ω-shaped spring 60 is fitted in the notch 47*b* where the cutter 48 is retracted to a safe state.

When the cutter 48 is worn, the plates 64 of the clamp body 45 are opened, and the cutter 48 is turned over, fitted on the protrusions 58, and fitted in one of the retaining portions 43 and used. When it is further worn, it is replaced with a new cutter in the cutter box 44.

Since the cutter 48, which is fitted in one of the two retaining portions 43 in the clamp body 45, is inclined relative to the angle ruler 42, there is a possibility that a thrust in the pull-out direction acts and the cutter 48 retracts together with the clamp body 45. Thus, as a fall-preventive means 70 for the clamp body 45, as in FIGS. 3–5 and 8, between the retaining portions 43 and the clamp body 45, a bolt (or engaging member) 71 is slidably provided. The bolt 71 is operated with a knob 72 provided on the outer surface of one of the retaining portions 43. (This fall-preventive means 70 can be mounted on either one of the retaining portions 43 on both wings of the angle ruler 42.

Figure 1B:
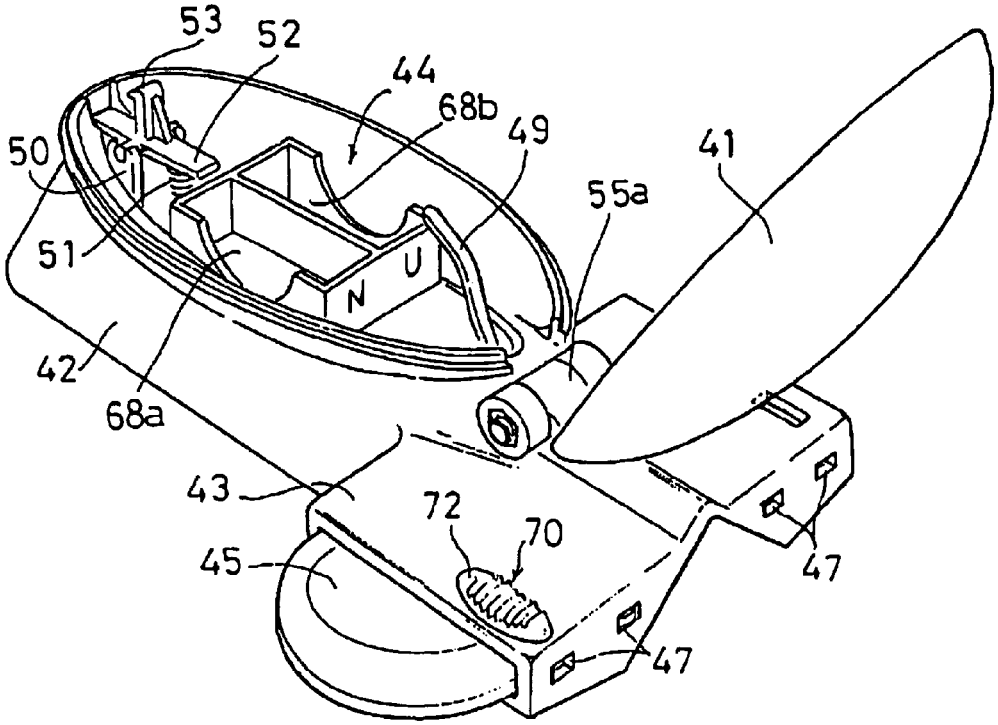
FIG. 1B is a perspective view thereof with the cutter box opened.
Figure 8A:
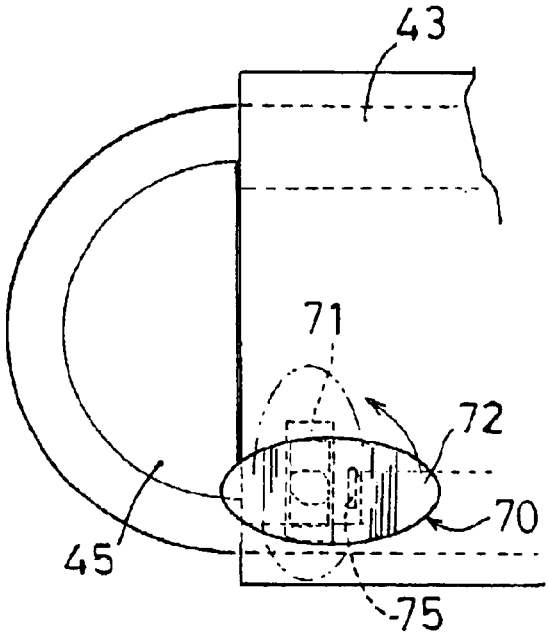
FIGS. 8A and 8B are views of the arrangement for preventing the clamp body from coming out.
Figure 8B:
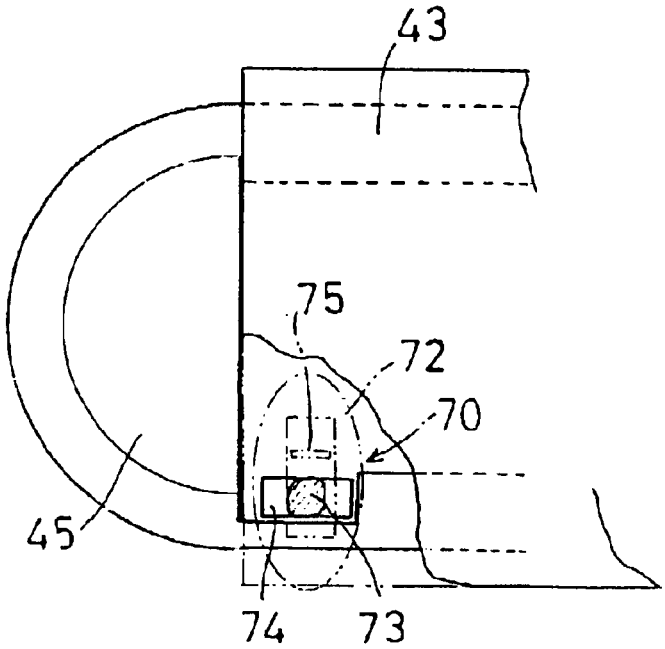
Figure 9A:
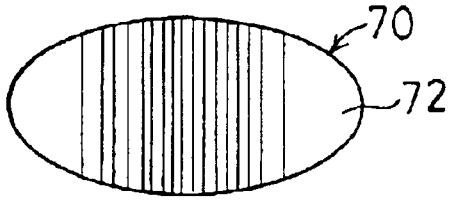
FIG. 9A is a plan view of a fall-preventive means.
Figure 9B:
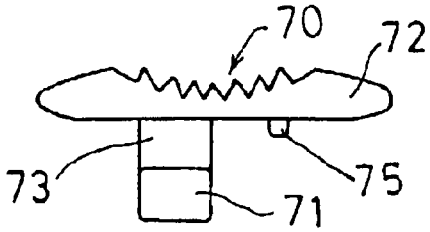
FIG. 9B is a front view of the same.
Figure 9D:
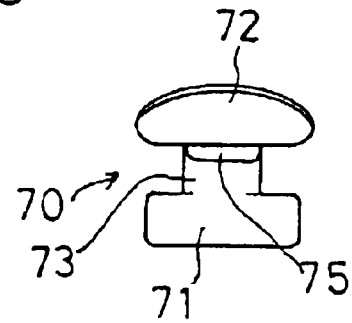
FIG. 9D is a right side view of the same.
Figure 9C:
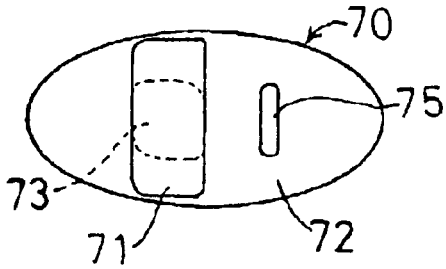
FIG. 9C is a back view of the same.

The bolt 71 and the knob 72 are integrally connected together by a square shaft 73. As for fitting in the retaining portion 43, when the bolt 71 is fitted in a square hole 74 as in FIGS. 3A and 8A and turned 90°, it becomes is placed in a state as shown in FIGS. 1B, 4 and 8B. When the knob 72 is slid, the bolt 71 also slides, and gets engaged in a cutout 69 formed in one of the side walls 63*c*, between the retaining portion 43 and the clamp body 45 to form the fall-preventive means 70.

When the bolt 71 and the knob 72, which are integrally connected together by the square shaft 73, are fitted in one of the retaining portions 43, they may run out in one of the rotational directions. A fall-preventive protrusion 75 is provided which slightly protrudes from the back of the knob 72. It fits in the opening of the square hole 74 to prevent runout of the fall-preventive means 70. Since the protrusion 75 protrudes only slightly, when the bolt 71 is inserted and turned 90°, the knob 72 will deform and make turning possible.

Instead of the bolt, a pin hole may be formed between the clamp body and each retaining portion and a pin may be inserted in the pin hole.

Figure 10:
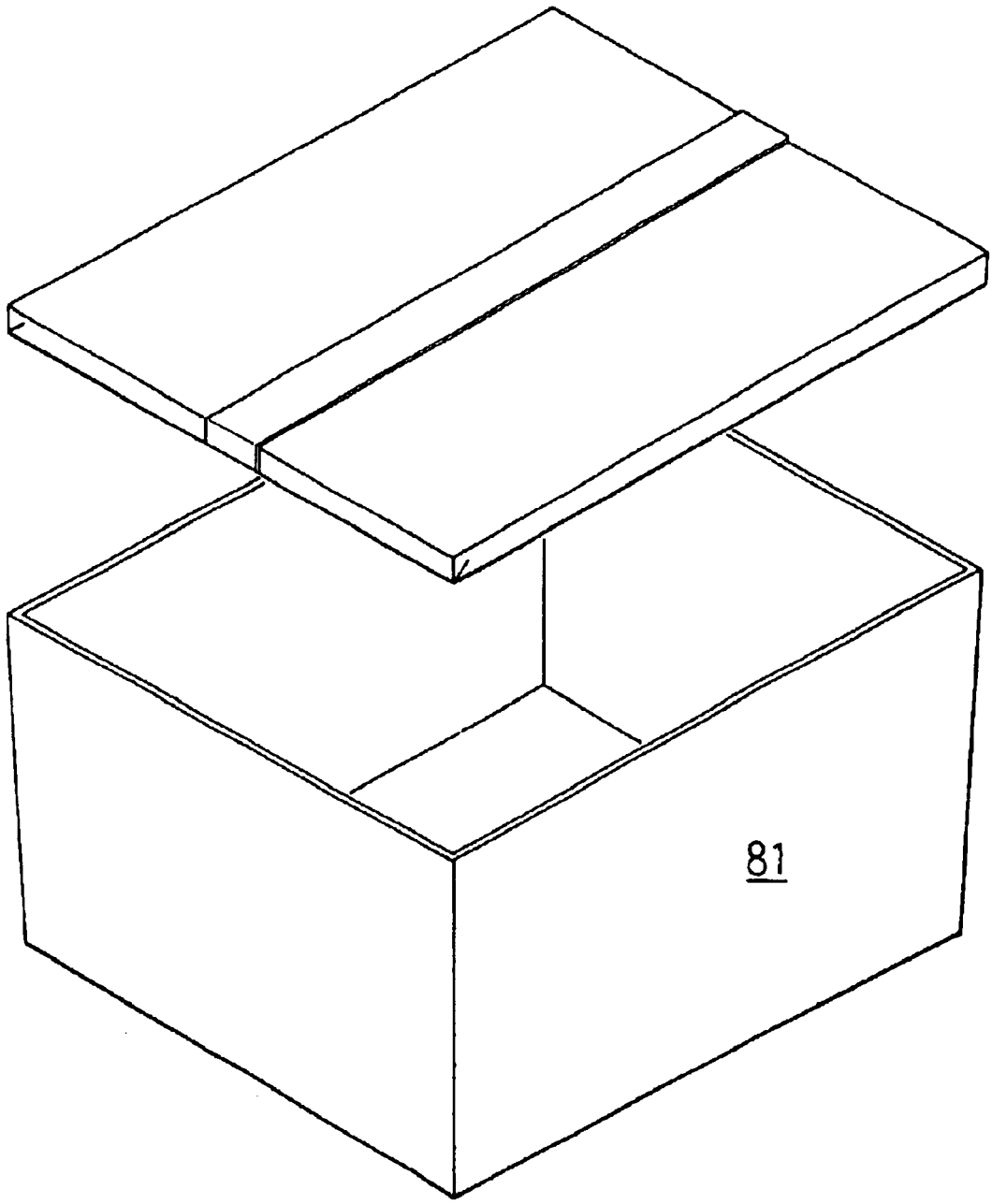
FIG. 10 is a perspective view of a carton after being opened.
Figure 11:
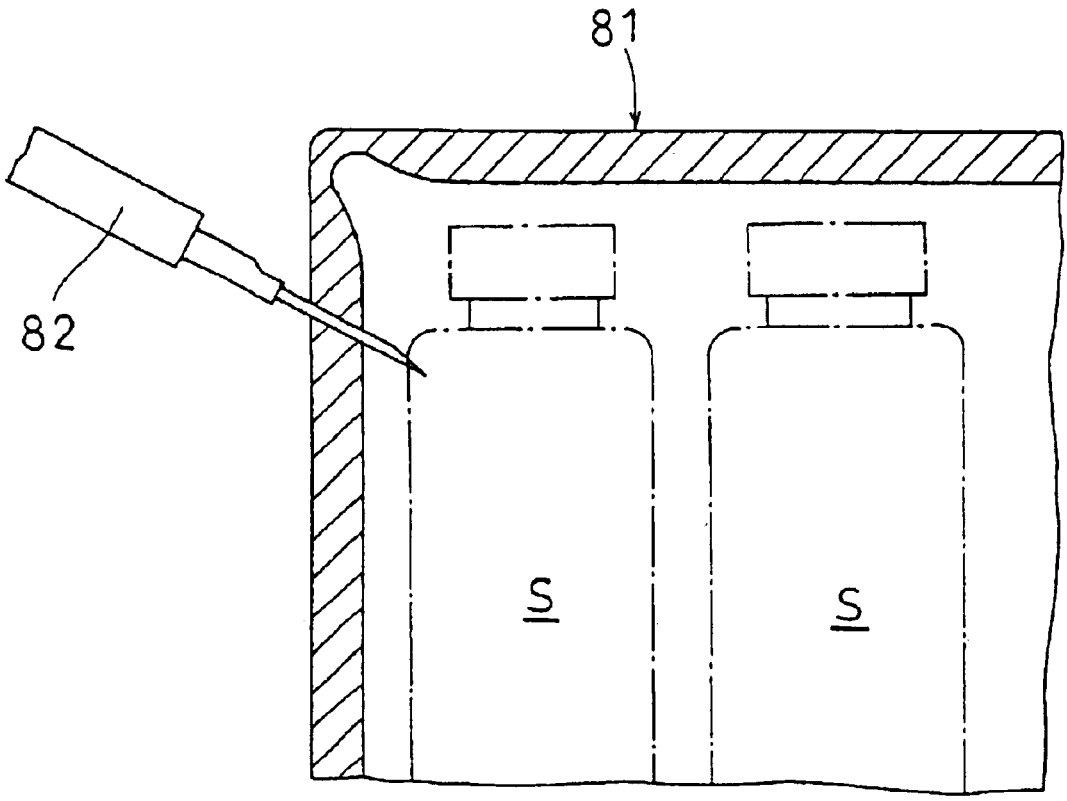
Fig.11 Prior Art
FIG. 11 is a view showing how a carton is opened with an ordinary cutter.

FIG. 10 shows how the carton is cut and opened with the package opening cutter according to this invention. It is cut cleanly along the top corners.

The package opening cutter is formed by injection-molding a plastic. But it may be formed by die casting of aluminum or its alloy.

As described above, according to this invention, merely by sliding the angle ruler with the cutter along ridges of a carton, it can be opened safely, reliably and quickly by forming a cut without damaging the merchandise inside. Even if it is repeatedly used, there is no worry of the cutter fitted in one of the retaining portions coming off.

What is claimed is:

1. A package-opening cutter comprising:

an angled ruler;

retaining portions provided on both sides of said angled ruler and each having an opening;

a clamp body provided so as to be pushed into and pulled out of said opening of either one of said retaining portions for clamping a cutter blade; and a locking arrangement for locking said clamp body in said opening of either one of said retaining portions;

wherein said locking arrangement includes a hole formed in each of said retaining portions, extending from an outer surface thereof to said opening thereof, and being elongated in a first direction, an elongated engaging member, a knob, and a shaft connecting said elongated engaging member to said knob, and an elongated cutout formed in said clamp body such that, when said clamp body is disposed in said opening of either of said retaining portions, said cutout is elongated in a second direction which is different than said first direction;

wherein said locking arrangement is configured such that, when said clamp body is disposed in said opening of one of said retaining portions, said elongated engaging member is engageable in said elongated cutout by inserting said elongated engaging member through said hole of the respective retaining portion to cause said engaging member to be disposed in said opening of the respective retaining portion and to cause said knob to remain exposed at an outer surface of the respective retaining portion, turning said knob by a predetermined angle, and sliding said knob in said first direction to cause said shaft to slide within said hole such that said engaging member engages in said cutout.

2. A package-opening cutter according to claim 1, wherein said locking arrangement further includes a protrusion formed on a backside of said knob facing toward said engaging member, so that said protrusion can be fitted in said hole of the respective retaining portion when said engaging member is disposed in said opening of the respective retaining portion.

3. A package-opening cutter according to claim 1, wherein said clamp body has a recess at a center portion thereof so as to define side walls along sides of said recess; and said cutout is formed in one of said side walls.

4. A package-opening cutter according to claim 3, wherein said retaining portions have ribs projecting into said openings thereof, respectively; and said ribs are engageable in said recess of said clamp body so as to prevent lateral shaking of said clamp body within the opening of the respective retaining portion.

5. A package-opening cutter according to claim 4, wherein said clamp body further includes a step provided adjacent said recess and connecting between said side walls.

* * * * *